United States Patent [19]

Beizerov et al.

[11] 4,065,634

[45] Dec. 27, 1977

[54] SKULL FURNACE FOR MELTING HIGHLY REACTIVE METALS UNDER VACUUM OR NEUTRAL ATMOSPHERE

[76] Inventors: Semen Moiseevich Beizerov, ulitsa B. Akademicheskaya, 73, korpus 2, kv. 72; Felix Petrovich Vyboischikov, ulitsa Studencheskaya, 38, kv. 31, both of Moscow; Vladimir Viktorovich Bloshenko, ulitsa Severnaya, 36, kv. 6, Odintsovo Moskovskoi oblasti; Jury Mikhailovich Syaskin, ulitsa Lobnenskaya, 9a, kv. 41, Moscow, all of U.S.S.R.

[21] Appl. No.: 660,461

[22] Filed: Feb. 23, 1976

[51] Int. Cl.[2] ..... F27D 7/06; F27D 9/00

[52] U.S. Cl. ..... 13/10; 13/31; 266/275

[58] Field of Search ..... 13/9, 10, 31, 32; 266/275

[56] References Cited

U.S. PATENT DOCUMENTS

| | | | |
|---|---|---|---|
| 2,960,557 | 11/1960 | Beecher et al. | 13/31 |
| 3,078,529 | 2/1963 | Cooper et al. | 13/31 X |
| 3,108,151 | 10/1963 | Garmy et al. | 13/10 |

*Primary Examiner*—R. N. Envall, Jr.

*Attorney, Agent, or Firm*—Lackenbach, Lilling & Siegel

[57] ABSTRACT

A skull furnace is provided with an expansion vessel filled with neutral gas and communicating with a cooling agent space made in the wall and bottom of a crucible. Used as a coolant is liquid metal cooling agent in which a tubular heat exchanger is immersed. The latter by its one end is connected with a cooling water inlet pipeline and by the other—with an outflow one. The heat exchanger may be constructed to have a double-layer wall with longitudinal passages having at their outlets cooling agent leakage indicators electrically connected with an alarm signalling device.

6 Claims, 4 Drawing Figures

SKULL FURNACE FOR MELTING HIGHLY REACTIVE METALS UNDER VACUUM OR NEUTRAL ATMOSPHERE

The present invention relates to metal production and namely to skull furnaces for melting highly reactive metals under vacuum or neutral atmosphere.

The development of modern engineering and technology in many industrial fields brings forth ever new requirements as to structural materials. These materials should be of high corrosion resistance in various aggressive media, high mechanical strength under low, moderate and high temperature conditions, heat resistance, and possess other specific properties, such as being non-magnetic, of low linear expansion coefficient, or high inertness to intrain slow neutrons.

Such materials meeting the above requirements are represented by highly reactive metals — titanium, zirconium and their alloys with other metals.

Though titanium is a sufficiently active metal, due to the creation of a dense protective film on its surface it possesses an exceptionally high resistance against corrosion, exceeding that of stainless steel. It resists oxidizing in air, sea water, remains unaffected in a number of chemically aggressive media, including diluted and concentrated nitric acid and even nitrohydrochloric acid. Due to this, titanium is an excellent material for the production of chemical apparatus. But the basic property of titanium contributing to its ever widening use in modern technology is high heat resistance both of titanium itself and its alloys. In addition, these alloys possess high-temperature strength, i.e. the ability to retain high mechanical properties at high temperatures. All this makes titanium alloys exceptionally valuable materials for the aircraft and rocket industry. Of high value is the fact that utilization of parts made of titanium and its alloys in internal-combustion engines makes it possible to reduce the mass of these parts approximately by 30%.

Useful properties of metallic zirconium include its high resistance to corrosion in various media. It is insoluble in acids and alkalis. Zirconium almost does not entrain slow (thermal) neutrons. This property in combination with high corrosion resistance and mechanical strength at high temperatures ranks zirconium and zirconium-based alloys among the principal structural materials for nuclear power reactors.

Broad possibilities of using titanium, zirconium and alloys based thereon give rise to intensive development of their production.

Obviously, all favorable properties of the above structural materials are manifest to the fullest only in the case when the basic technological melting equipment is able to produce high quality metal for turning out ingots and blanks of dimensions and shapes as are required.

As at high temperatures, titanium and zirconium react with the atmospheric gases, melting of these metals is carried out under vacuum or argon medium.

One of the ways of producing highly reactive metals in a compact arrangement is melting in a skull furnace under vacuum or neutral atmosphere conditions. Such melting permits simultaneously to produce a large amount of metal and to isolate it from interaction with the crucible material. The thus melted metal can be used for casting ingots and shaped blanks. Metal melting in the skull crucible of a vacuum furnace yields a number of advantages as compared with metal melting in a mould. In this case, selection of charge components, delivery of charge to the melting point, metallurgical treatment of the melt are made easier and, besides, a fine-grain structure of ingot is obtained, remelting of waste is simplified, and conditions for centrifugal casting of metal blanks are procured.

Skull furnaces permit melting of metals both in vacuum and neutral atmosphere with the utilization of dependent source of heat (consumable electrode) and independent source of heat (nonconsumable electrode, plasmatron, electron-beam gun).

Therefore, an ever growing position in the world practice of producing highly reactive metals is occupied by vacuum skull furnaces, especially electric arc furnaces with consumable and nonconsumable electrodes.

This is accompanied with an obvious trend towards increasing the capacity of furnaces as to the volume of metal melted, by way of enlarging the volume of the skull crucible.

The skull crucible is the basic and very important component of a furnace, whose design and thermal conditions, determine the quality of metal produced, safety and efficiency of the metal melting process and reliable functioning of the entire furnace.

Operation of the skull crucible is accompanied with a higher thermal intensity as compared with the electrode holder or the furnace body. Dissipated through its walls is usually 40–70% of heat generated by electric arc.

There known several types of skull crucibles for melting highly reactive metals under vacuum or neutral atmosphere conditions. These are cooled metal graphite-lines crucibles and non-cooled metal crucibles, as well as gas and water cooled metal crucibles. Temperature distribution in the graphite-lined crucible depends to a considerable extent on the clearance between the crucible body and the water-cooled case. Enlargement of this clearance may cause melting of the skull to result consequently in intensified interaction of molten metal and graphite lining, intrusion of metal into graphite and cracking of the graphite lining. The molten metal will be substantially contaminated with graphite.

The dissipation of heat from the skull in a crucible of heat-absorbing type and in having blown therewith neutral gases is insufficient under the metal melting conditions, which leads to considerable heating of the crucible, melting of the skull, fusion of crucible walls and contamination of the metal bath with the crucible wall material.

Therefore, for melting highly reactive high-melting point metals it is preferable to employ a vacuum electric arc furnace furnished with a water-cooled metal skull crucibles.

The principle drawback of such a furnace is the occasional melting through of the wall of the crucible body by an electric arc or secondary arcs, and thus creating the danger of an explosion due to water penetrating into the furnace chamber. An explosion takes place with violent steam generation, when water gets under the layer of liquid metal, or due to the creation of an explosive mixture in the furnace chamber with decomposition of steam under high temperature conditions and reactivity of molten highly reactive metal.

When melting metal is in an electric arc skull furnace, electrical, metallurgical, hydrodynamic and thermal processes take place in the bath. All of them are interdependent and interrelated, however thermal processes are the basic ones. Qualitative and quantitative indices such as actual metal melting depend to a great extent on the character of these processes. Thus, the metal melting conditions and operation of the furnace on the whole depend on the efficiency and functional reliability of the skull crucible cooling system. In this connection, the problems of selection and application of a cooling agent in the cooling system are closely and unbreakably linked, primarily, with the problems of ensuring explosion proofness of the melting apparatus and safety attendance of the heat exchanging circuit. In addition to the requirements of explosion proofness a need arises of taking into account the thermophysical properties of the cooling agent, corrosive-erosive effect on the materials of cooling system walls, degree of its toxicity, fire safety, commercial availability, experience of employment in other industrial fields, and even psychological factor.

There known vacuum electric arc furnaces for melting highly reactive metals in molds, whose cooling systems employ a cooling agent in the form of a eutectic sodium-potassium alloy. In these furnaces, dissipation of heat from the mold walls is effected by the sodium-potassium alloy under forced movement of the cooling agent in the mold cooling space. The principal advantage of these furnaces as compared with water-cooled as well as with vacuum electric arc skull furnaces with water-cooled metal crucible. These furnaces however, due to the incorporation of the forced-circulation heat-exchanging circuit, also incur a number of structural and operational deficiencies.

A furnace for vacuum electric arc melting of highly reactive metals furnished with a liquid metal cooling system is a rather complex apparatus. Its heat-exchanging circuit includes a mold with a sodium-potassium cooling agent, electromagnetic pumps, air heat exchanger with a powerful fan, oxide trap with fan, drain and expansion vessels, pipelines with stopping liquid metal fittings, and measuring instruments including electromagnetic flow meters.

Operation of this equipment is equal to that of a separate production department and obviously requires permanent attention on the part of skilled attending personnel.

Great length of pipelines and incorporation of structurally complicated units and elements of the liquid metal cooling system leads to a situation when a substantial amount of eutectic sodium-potassium alloy is permanently found beyond the mold cooling space. This is disadvantageous from the point of view of economical usage of the liquid metal cooling agent. On the other hand, servicing of the external sections of the heat exchanging circuit is very dangerous. Despite the fact that a cooling agent flow velocity in the circuit does not exceed the maximum permissible value of 8 m/s, the walls of pipelines undergo intensive corrosive-erosive destruction. This brings an operational danger because at any moment of time a break through the pipeline wall is possible, accompanied with a throw of sodium-potassium alloy into the production building. Particularly dangerous is such a disaster at the section where the heated cooling agent is delivered from the mold cooling space into the air heat exchanger, as the liquid sodium-potassium alloy is of high temperature and consequently there is a possibility of its inflammation and hitting the attending personnel. Due to this, selection of materials for the cooling circuit elements and the technology of manufacturing the cooling system should be absolutely faultless.

Particularly rigid requirements are set forth as to the tightness of the entire system, wherein the circuit joints should be welded or soldered up and tested by reliable quality control methods, including X-ray and gamma-ray inspection, and checking for tightness of halide or gallium leak detectors. Disturbed tightness of the system develops in the course of its operation with its lengthy pipelines and the considerable number of units and elements in the heat exchanging circuit, and as well a corrosive-erosive wear of the cooling system wall material leads to a situation when the circuit constantly accumulates solid oxides capable of blocking the pipelines. With respect to this, special responsibility is accured to the functioning of the oxide trap. unfavorable in this case is also the fact that the circuit needs to be replenished with fresh portions of liquid metal cooling agent.

So, complicated design and attendance, danger of throwing liquid alkali metal out of the circuit, and degraded operational dependability of the melting apparatus instantly require searching for new ways of solving the problems of explosion-proofness of furnaces intended for melting highly reactive metals.

The principal object of the present invention is to provide a skull furnace for melting highly reactive metals under a vacuum or neutral atmosphere, which would be safe with respect to explosions due to the application therein of a crucible adapted for utilization of liquid metal cooling agent.

Another no less important object of the invention is to improve the operational dependability of the furnace by way of continuous quality control over the walls of the tubular heat exchanger and the crucible body directly in the course of metal melting, and taking timely measures for preventing breakdown.

An important object of the invention is to increase a unit productive capacity of the furnace as to the amount of metal melted by way of enlarging the crucible cubicle capacity resulted from the application of a liquid metal cooling agent.

One more object of the invention is to make the furnace convenient and safe for the operators or attendants as it is used in the course of its operation.

These objects of the present invention are achieved by providing a skull furnace for melting highly reactive metals under a vacuum or neutral atmosphere, comprising a horizontally split body mounted on a support frame, and fixed in said body with vertical displacement is an electrode holder and positioned below the latter but above a plate-mounted casting mold with funnel is a crucible provided with a drive for turning around horizontal axis and having double walls and bottom forming a space for cooling agent, whereas according to the invention the furnace incorporates an expansion vessel filled with a neutral gas and communicating with the crucible space filled with liquid metal cooling agent, the latter space accomodating a tubular heat exchanger connected to cooling water inflow and outflow pipelines.

The furnace of this design with a skull crucible for melting highly reactive metals allows cooling of the crucible body walls to be effected with a liquid metal cooling agent, such as eutectic sodium-potassium alloy which in the case of melting through the crucible body and penetration into the layer of molten highly reactive metal prevents an explosion, because the physicochemical interaction of liquid metals under any conditions, including high-temperature conditions under vacuum, is taking place absolutely quietly.

Incorporation of an expansion vessel filled with neutral gas and communicating with a cooling agent space located respectively between the walls and bottom of the crucible body and the crucible housing and filled with liquid metal cooling agent permits unobstructed volume expansion of the cooling agent during its heating in the course of metal melting, which prevents pressure increase in the cooling agent space to a value capable of causing deformation or destruction of the crucible housing and body walls.

A crucible heat exchanger accomodated in the cooling agent space makes it possible to do away with a forced circulation circuit of liquid metal cooling agent and, instead to arrange an open water circuit, which in its turn would make attendance safer, improve operational reliability of the furnace and simplify its use.

It is expedient to provide the expansion vessel with and electric contact pressure gauge electrically wired with an alarm signalling device and/or an indicating pressure gauge connected to a flexible pipeline to make said vessel communicating with a neutral gas bottle disposed beyond the furnace body.

This will permit in the course of metal melting to effect continuous control over the tightness of the cooling agent space in the crucible. In the case of melting through or destruction of the crucible body, there occurs a leakage of liquid metal cooling agent and neutral gas thus leaked from this point into the furnace and, this would initiate a sharp pressure drop in the expansion vessel to be immediately detected by a pressure gauge and the latter through electric contacts would switch on the alarm signalling device and discontinue the metal melting process.

Advantageously, the tubular heat exchanger is made with a double-layer wall and with longitudinally directed passages between the wall layers, the end portions of the tubular heat exchanger are inserted through the holes in the crucible wall and secured tightly and their outlets are fitted with cooling agent leakage indicators being electrically connected with the alarm signalling device.

This will aid in the continuous and timely control over heat exchanger tightness and in case of disturbed heat exchanger wall tightness to produce a reliable signal, warning about the appearance of the cooling agent in the passages, because this signal will close the electric contacts of the leakage indicator. Detection of defects in the heat exchanger helps to prevent a breakdown and aids in the overall elimination of these defects.

It is advisable to equip the crucible with at least one neutral gas header communicating with the passages positioned between the layers of the tubular heat exchanger wall and to construct the header in such a way that its wall at one side is formed by the crucible wall and at the other — by the walls of cooling water inflow and out flow headers.

This structural embodiment of gas and water headers permits during operation of the furnace dependable control over both the tightness of the crucible tubular heat exchanger and that of its passing points through the crucible housing wall and through the water header walls.

Disturbed tightness at these points and leakage of liquid metal cooling agent into the gas header causes the electric contacts of leakage indicators (for example automobile spark plugs) to close and to produce an alarm signal. In this case, the gas header disposed between the cooling agent space and the water header fully prevents penetration of one cooling agent into the other and their chemical interaction.

Electrical audible and/or visual signalling devices can be used as an alarm signalling device to warn about disturbed tightness of the crucible cooling agent space, tubular heat exchanger, gas and water headers.

This affords visual and/or audible indication of the crucible condition, thus improving dependability of operational control over the equipment directly in the course of metal melting in the furnace.

The invention will be more clearly understood from the following description of its embodiment given by way of example with reference to the accompanying drawings, in which.

Figure 1:
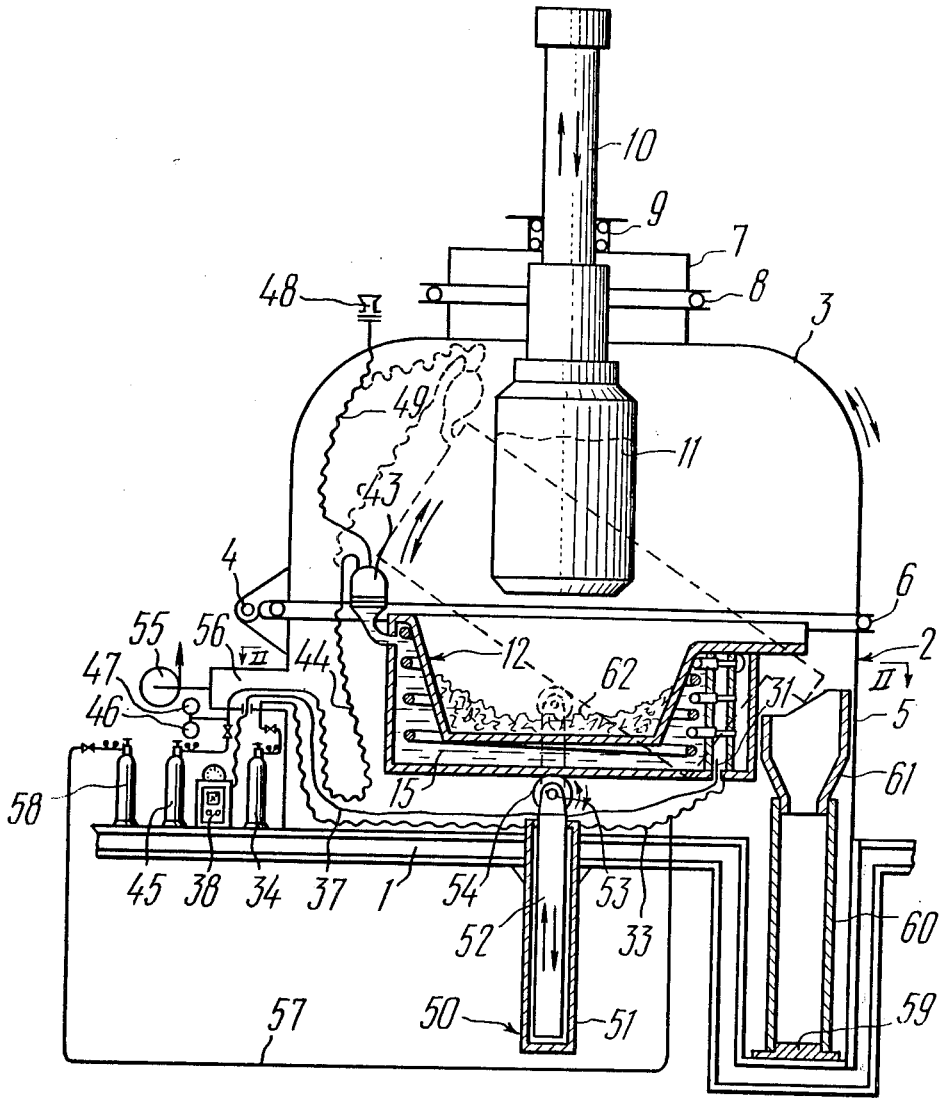
FIG. 1 is an elevation sectional view over the longitudinal axis of a skull furnace.

A skull furnace for melting highly reactive metals under vacuum or neutral atmosphere comprises a support frame 1 (FIG. 1) which mounts a horizontally split body 2 having a crown 3 capable of turning about horizontal axis in a hinge 4, and a lower portion 5, between which and the crown a seal 6 is placed made of vacuum-treated rubber, a cover 7 sealed at the place of contact with the upper portion of the crown 3 by means of a vacuum-treated rubber gasket 8.

Secured in the cover 7 with possible vertical displacement through a seal 9 is an electrode holder 10 for securing a consumable electrode 11 thereto and feeding it with electric power from an electric power source (not shown).

Figure 2:
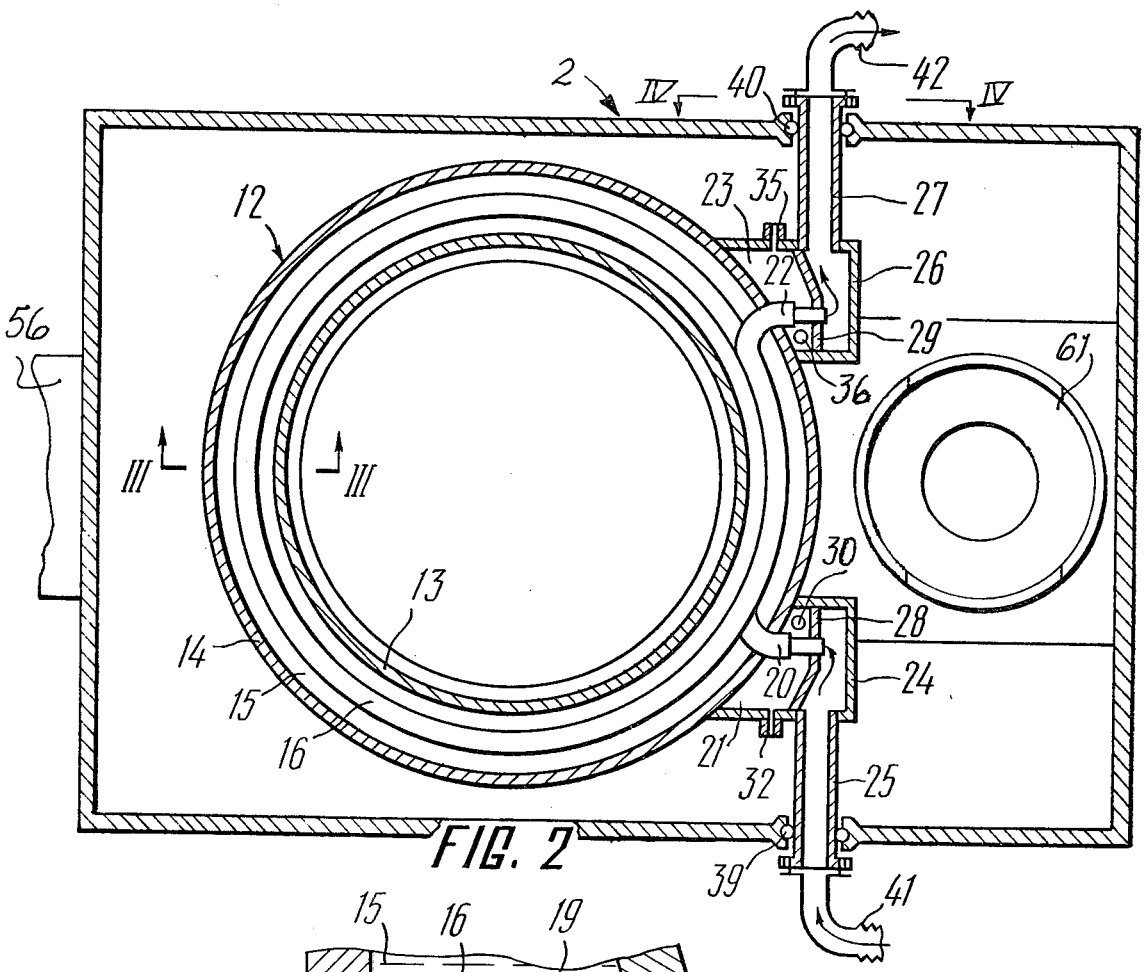
FIG. 2 is a cross-sectional view taken along the line II—II of FIG. 1, on an enlarged scale.

Mounted inside the body 2 is a skull crucible 12 capable of turning around horizontal axis. The crucible includes a body 13 (FIG. 2) and a housing 14, and a cooling agent space 15 located between their walls and bottom.

In the given example, the role of a cooling agent is performed by an eutectic sodium-potassium alloy known as liquid metal cooling agent. Laid through the space 15 is a tubular heat exchanger 16 made of two coaxial and contacting each other tubes — inner 17 (FIG. 3) and outer 18, forming the double-layer wall of the heat exchanger 16.

The external side of the tube 18 of the heat exchanger 16 is in contact with the liquid metal cooling agent filling the space 15. Provided in the heat exchanger 16 between its tubes 17 and 18 forming the layers of its wall, are passages 19 located longitudinally, and the ends of the tubular heat exchanger 16 (FIG. 2) are laid through the holes in the walls of the housing 14 of the crucible 12 (FIG. 1) and secured snug and tight.

The outer tube 18 (FIG. 3) of the heat exchanger 16 at one end 20 (FIG. 2) of the heat exchanger enters a gas header 21, and at its other end 22 enters a gas header 23. The above mentioned headers 22 and 23 are filled with inert gas, for example argon and, consequently, the passages 19 (FIG. 3) connected with the above headers are also filled with inert gas.

The inner tube 17 of the heat exchanger 16 is laid with its end sections through the headers 21 (FIG. 2) and 23, but is not in communication with them. The inlet end of the inner tube 17 (FIG. 3) is inserted into an inflow header 24 (FIG. 2) with a tube connection 25 for cooling water inflow, while the outlet end of the inner tube 17 (FIG. 3) is inserted into an outflow header 26 (FIG. 2) with a tube connection 27 for outflow of water used for cooling the crucible 12. The gas header 21 is separated from the water inflow header 24 by a wall 28. Correspondingly, the gas header 23 is separated from the water outflow header 26 by a wall 29.

Figure 3:
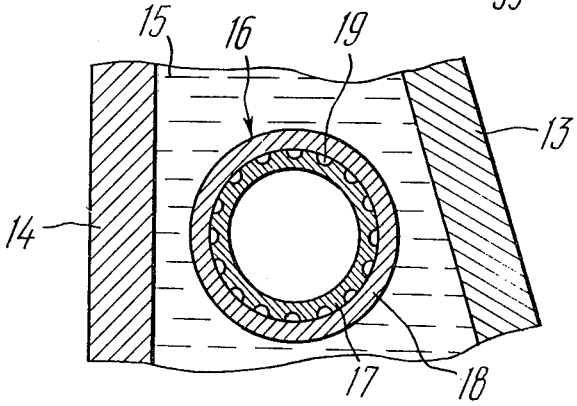
FIG. 3 is a fragmentary sectional view taken along the line III—III of FIG. 2, on an enlarged scale.

Introduced into the gas header 21 through a hole 30 in the bottom of said gas header and secured therein is a cooling agent leakage indicator 31 (FIG. 1) which may be represented by an automobile spark plug, for example. Attached to a pipe connection 32 (FIG. 2) of the gas header 21 is a flexible metal pipeline 33 (FIG. 1) communicating with a bottle 34 intended for the delivery of inert gas into the gas header 21 (FIG. 2) and into the passages 19 (FIG. 3).

The gas header 23 (FIG. 2) has a pipe connection 35 for neutral gas delivery and a hole 36 for installing a cooling agent leakage indicator therein similar to the above described gas header 21. The cooling agent leakage indicators (FIG. 1) installed in the gas headers 21 and 23 (FIG. 2) are in permanent electrical connection by way a cable 37 (FIG. 1) with an alarm signalling device 38 including an electric unit to control visual and/or audible signalling devices, i.e. electric lamps and/or horns. These permit supervision over the sections of the wall of the housing 14 (FIG. 2), said wall being common for the gas headers 21 and 23, walls 28 and 29 in these headers, the walls of the tubes 17 (FIG. 3) and 18 and, consequently, there will be effected continuous supervision over the tightness of gas headers 21 and 23 (FIG. 2), water headers 24 and 26, and the tubular head exchanger 16.

Figure 4:
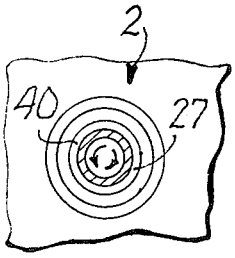
FIG. 4 is a cross sectional view taken along the line IV—IV of FIG. 2.

Pipe connections 25 and 27 of water headers 24 and 26 are secured in the furnace body 2 by means of seals 39 and 40 made of vacuum-treated rubber, said seals permitting reversible turning therein of the pipe connections with respect to horizontal axis. This turning is performed when the crucible 12 is inclined for pouring molten metal out of it and returned to its initial position. For supplying the tubular heat exchanger 16 of the crucible 12 with cooling water, provision is made of a water inflow pipeline 41 and a water outflow pipeline 42. Both pipelines 41 and 42 are flexible and they do not prevent turning the crucible 12 with respect to horizontal axis as best shown by the directional arrow heads for FIG. 4.

The furnace crucible 12 (FIG. 1) is provided with an expansion vessel 43 filled with neutral gas, for example argon. This vessel 43 is in communication with the cooling agent space 15 and it allows the liquid metal cooling agent to expand at heating in the course of metal melting. The expansion vessel 43 is connected by means of a flexible metal pipeline 44 with a gas bottle 45 located beyond the furnace body 2 and intended for the delivery of neutral gas into said vessel.

The effect control over the tightness of the cooling agent space 15 of the crucible 12 in the course of metal melting, connected to the flexible metal pipeline 44 are an electric contact pressure gauge 46 and an indicating pressure gauge 47 located beyond the furnace body 2.

The electric contact pressure gauge 46 is electrically wired (not shown) with the alarm signalling device 38.

The expansion vessel 43 is provided with a protective device 48 to release surplus pressure when the pressure exceeds the maximum value. This device is installed beyond the furnace body 2 and connected with the expansion vessel 43 by a tight metal pipeline 49.

Mounted below the skull crucible 12 in the lower portion of the furnace body 2 is a hydraulic drive 50 for turning the crucible 12, said drive comprising a hydraulic cylinder 51, movable rod 52, axle 53 and roller 54, supporting the crucible 12.

The furnace is equipped with a vacuum pump 55 for creating vacuum therein and is connected with the pump through a vacuum line 56. Laid through the wall of the vacuum line 56 are airtight sealed pipelines 44 and 33 for the delivery of neutral gas into the expansion vessel 43, and the gas headers 21 and 23, and also the cable 37 of the cooling agent leakage indicator 31.

In the skull furnace according to the invention it is possible to effect metal melting under atmosphere. With this in view, there provided a pipeline 57 connected to a bottle 58 installed on the support frame 1.

Installed in a recess of the furnace body 2 below the crucible 12 is a plate 59 carrying a casting mold 60 with a filling funnel 61.

The casting mold 60 together with the plate 59 is designed for forming an ingot of metal lumps 62 charged into and melted in the crucible 12, and of the metal of the consumable electrode 11 melted in the crucible 12.

In another embodiment, the skull furnace according to the invention may have a single gas header receiving the ends 20 (FIG. 2) and 22 of the tube 16 (FIG. 3). In this case, one wall of the gas header is formed by the wall of the housing 14 of the crucible 12, while the other wall is formed by the partitions (walls) 28 and 29 of the cooling water inflow and outflow headers 24 and 26.

The skull furnace for melting highly reactive metals operates as follows.

During the period of preparing the furnace for metal melting, the consumable electrode 11 (FIG. 1) is fixed on the electrode holder 10 by means of electric arc, inside the closed body 2. Then, with the crown 3 tipped up, waste metal lumps 62 (FIG. 1) intended for melting are placed on the bottom of the body 13 (FIG. 2) of the crucible 12. Thereafter, the crown 3 is lowered down, the body 2 is closed airtight and by means of the vacuum pump 55 and via the vacuum line 56, vacuum is created inside the furnace.

For melting metal under neutral atmosphere, gas is delivered into the furnace from the bottle 58 via the pipeline 57. Then, electric power is supplied to the electrode 11 through the electrode holder 10, an electric arc is initiated between the consumable electrode 11 and waste metal lumps 62 and the metal melting process is carried out. As the consumable electrode 11 is being melted off, the electrode holder 10 is lowered down through the seal 9 which permits sliding therethrough.

The metal melting process is continued until the required amount of metal is collected in the crucible 12, then the process is discontinued, power supply is switched off, and the electrode holder 10 is moved upwards. Now, the hydraulic drive 50 is actuated for turning the crucible 12 with respect to horizontal axis, and as a result of that, the molten metal intended for forming a metal ingot is poured out of the crucible mold 12 into the funnel 61 and therefrom into the casting as shown by the phantom lines of 60 FIG. 1. After that, the hydraulic drive 50 is reversed for the crucible 12 to return to the initial position. Upon cooling of the skull in the crucible 12 and of the metal ingot in the casting mold 60 down to the discharge temperature, the furnace is filled with air, the crown 3 of the furnace body 2 is tipped up and a ready ingot is taken out. Note also that the arrowheads shown in FIG. 4 inside the pipe 27 show the direction of rotation of the pipes (27 and 25) and, consequently, of the crucible 12 which is rigidly coupled thereto.

In the course of metal melting in the furnace, the body 13 (FIG. 2) of the crucible 12 undergoes considerable thermal loads and transmits them to the liquid metal cooling agent located in the cooling agent space 15, free convection of said cooling agent being intensified as it is being heated. Cooling of the liquid metal cooling agent in the space 15 is effected by means of the double-layer tubular heat exchanger 16 with cooling water flowing inside thereof. Water enters through the inflow pipeline 41 into the pipe connection 25 and inflow header 24, and is brought away via the outflow header 26, pipe connection 27 and outflow pipeline 42. As the crucible is being heated, the volume of the liquid metal cooling agent starts increasing due to thermal expansion. The surplus amount of the cooling agent is rising from the space 15 to flow into the expansion vessel 43 (FIG. 1) filled with neutral gas. As the crucible 12 is cooled down on completion of metal melting, the liquid metal cooling agent lowers to flow into the space 15.

Should an emergency situation arise, such as melting through the wall of the body 13 (FIG. 2) of the crucible 12 (FIG. 1), the neutral gas displaces the liquid metal cooling agent from the cooling agent space 15 into the inner cavity of the furnace body 2. This is immediatelly followed with a pressure drop in the expansion vessel 43, so as to signal actuation of the electric contact pressure gauge 46 electrically wired with the alarm signalling device 38 so that the lamp is switched on, and simultaneously the horn is actuated to warn that the metal melting process should be discontinued.

Later, the body 13 (FIG. 2) of the crucible 12 is subjected to repairs. Though there are no causes for the origination and the effects of mechanical and thermal loads on the heat exchanger 16 (FIG. 2) in the course of operation because the double-layer tubes are secured in the wall of the housing 14 in such a way that their length variations due to thermal expansion can be compensated for, however in case of a defect in the heat exchanger tubes or a loose point in the layers of the tubes 17 or 18 (FIG. 3), as well as in case of a loose point in the wall of the housing 14 (FIG. 2), gas headers 21 and 23 and in the walls 28 and 29 between the gas and water headers 24 and 26, the cooling agent (eutectic sodium-potassium alloy or water) enters into the gas header 21 or 23, reaches the electric contacts of the leakage indicator 31 (FIG. 1); closes these contacts and actuates the alarm signalling device 38 connected with the indicator to produce a visual and/or audible signal.

Testing of a skull furnace for melting highly reactive metals under vacuum or neutral atmosphere at 1000 kW power capacity has proved its high efficiency, as well as the operational reliability of the tightness control system of the crucible and the cooling system units. The results of tests afford the basis for the development of powerful furnaces for melting highly reactive metals, furnished with independent head sources (plasmatrons, electron guns) and automatic control arrangement.

What we claim is:

1. A skull furnace for melting highly reactive metals under vacuum or in a neutral atmosphere provided by a neutral gas source, comprising: a support frame; a body of said furnace rigidly mounted on said frame, and said body being horizontally split so as to form a lower portion and an upwardly tiltable crown hinged at one side for opening and closing said furnace; a movable electrode holder secured to said crown in a substantially vertical position so as to be reciprocably movable back and forth from an upper idle position to a lower working position; a tiltable crucible having an inner body and an outer housing located below said electrode holder in the body of said furnace and having a cavity therebetween for a liquid metal cooling agent, said cavity being entirely confined between the body and housing of said crucible to provide, when the furnace is in the working position, for the free convective motion of said liquid metal cooling agent for cooling the body of said crucible; an expansion reservoir filled with a neutral gas and communicating with said cavity for receiving the excess of said cooling agent when it expands during the melting process; a safety device mounted outside said body of said furnace for relieving the excess pressure from said expansion reservoir; a tubular heat exchanger placed in said cavity for the liquid metal cooling agent, the ends of which are connected to cooling water collectors; pipes rigidly connected with said cooling water collectors, extending along the sides of said crucible, and hermetically passing through the walls of said body of the furnace generally below said crown, and being supported so as to allow the tilting of said crucible for pouring out the molten metal and said pipes are connected to respective flexible water inlet and outlet pipe lines.

2. The skull furnace according to claim 1, including an electric contact pressure gauge associated with said expansion reservoir for furnishing an electric signal in response to abnormal deflection of pressure inside said expansion reservoir from a predetermined value, said electric contact pressure gauge being operably connected to the neutral gas source; and an indicating gauge associated with said expansion reservoir for visually controlling the pressure therein; an alarm signalling means electrically connected with said electric contact pressure gauge for the visual or audible indication of an emergency situation in said expansion reservoir and said cooling agent cavity arising when pressure deviates abnormally from a predetermined value.

3. The skull furnace according to claim 1, wherein said heat exchanger comprising tubes with double-layer walls, with longitudinal passages being provided between the wall layers; said tubes being located in said cavity for the liquid metal cooling agent, the end portions of the outer layer of said tubes being hermetically passed through and secured in openings provided in said housing of the crucible so as to terminate flush with the outlets of said openings in said crucible housing, and the end portions of the inner layer of said tube walls being hermetically connected to the cooling water collectors located at opposite sides of said crucible; and said furnace including cooling agent leak indicating means positioned underneath the ends of said outer layer of said double-layer tubes so that when leakage of said cooling agent occurs due to a defect in one of the layers of said double-layer tubes, said cooling agent will be guided along said longitudinal passages in said tubes towards said cooling agent leak indicating means.

4. The skull furnace according to claim 3, including a sealed gas collector means for accommodating said cooling agent leak indicating means defined on one side by the wall of said housing and on the other side by the wall of said cooling water inlet and outlet collectors and being located respectively at the opposite sides of said crucible, and said longitudinal passages in said double-layer tubes communicating with the interior spaces of said gas collector means.

5. The skull furnace according to claim 3, including a sealed gas collector means for accommodating said cooling agent leak indicator means located between the housing of said crucible and said cooling water inlet and outlet collectors, and said longitudinal passages provided in said double-layer tubes communicating with the gas-filled chamber of said gas collector means.

6. The skull furnace according to claim 3, including alarm signalling means for visually or audibly warning about tightness faults in said cavity for said cooling agent, said tubular heat exchanger and said gas and water collector means, and said signalling means being electrically connected with said cooling agent leak indicating means.

* * * * *